US005273353A

United States Patent [19]

Twellmann

[11] Patent Number: 5,273,353

[45] Date of Patent: Dec. 28, 1993

[54] HARDWARE FOR CORNER CABINET

[75] Inventor: Guenter Twellmann, Spenge-Lenzinghausen, Fed. Rep. of Germany

[73] Assignee: Ninkaplast GmbH, Bad Salzuflen, Fed. Rep. of Germany

[21] Appl. No.: 905,570

[22] Filed: Jun. 29, 1992

[30] Foreign Application Priority Data

Jun. 29, 1991 [DE] Fed. Rep. of Germany ... 9108037[U]

[51] Int. Cl.[5] ..... A47B 97/00

[52] U.S. Cl. ..... 312/238; 211/144

[58] Field of Search ..... 312/238, 125, 135, 305; 211/144

[56] References Cited

U.S. PATENT DOCUMENTS

| | | | |
|---|---|---|---|
| 2,637,613 | 5/1953 | Motter | 312/238 |
| 2,698,776 | 1/1955 | Stoeckl | 312/305 |
| 3,868,156 | 2/1975 | Vanderley | 211/144 |
| 4,146,280 | 3/1979 | Crownhart | 312/305 |
| 4,181,037 | 1/1980 | Boon et al. | 312/125 |
| 4,433,885 | 2/1984 | Baker | 312/135 |
| 4,440,459 | 4/1984 | Hallgren | 312/238 |

FOREIGN PATENT DOCUMENTS

| | | |
|---|---|---|
| 0451737 | 10/1991 | European Pat. Off. . |
| 0477526 | 4/1992 | European Pat. Off. . |
| 7736498 | 8/1978 | Fed. Rep. of Germany . |
| 8705055.2 | 9/1988 | Fed. Rep. of Germany . |
| 9014366 | 2/1991 | Fed. Rep. of Germany . |

*Primary Examiner*—Kenneth J. Dorner
*Assistant Examiner*—Janet M. Long
*Attorney, Agent, or Firm*—Foley & Lardner

[57] ABSTRACT

Mounting for a corner cupboard door which is held for co-rotation on a carousel having at least two compartment floors, which mounting includes a telescopic mechanism for the radially movable fastening of the door on the carousel, and a control cam mechanism which acts between a part fixed to the door and the cupboard body and which holds the door in an inwardly retracted position when the carousel is turned out of the starting position, while permitting an outward movement of the door into the closed position when the carousel returns to the starting position, characterized in that the telescopic mechanism has a box-shaped telescopic casing which extends in height over the space between at least two compartment floors and in which an extensible door holder is guided, which is adapted to the inside contour of the telescopic casing, and further characterized in that a toothed bar is disposed both at the top end and at the bottom end in the telescopic casing, and at least one vertical shaft which at its top and bottom ends is provided with gears meshing with the toothed bars, the door holder being mounted in the telescopic casing via said vertical shaft and said gears so that during the inward and outward movement of the door holder in the telescopic casing synchronism is achieved by constraint between the top and bottom ends of the door holder.

9 Claims, 7 Drawing Sheets

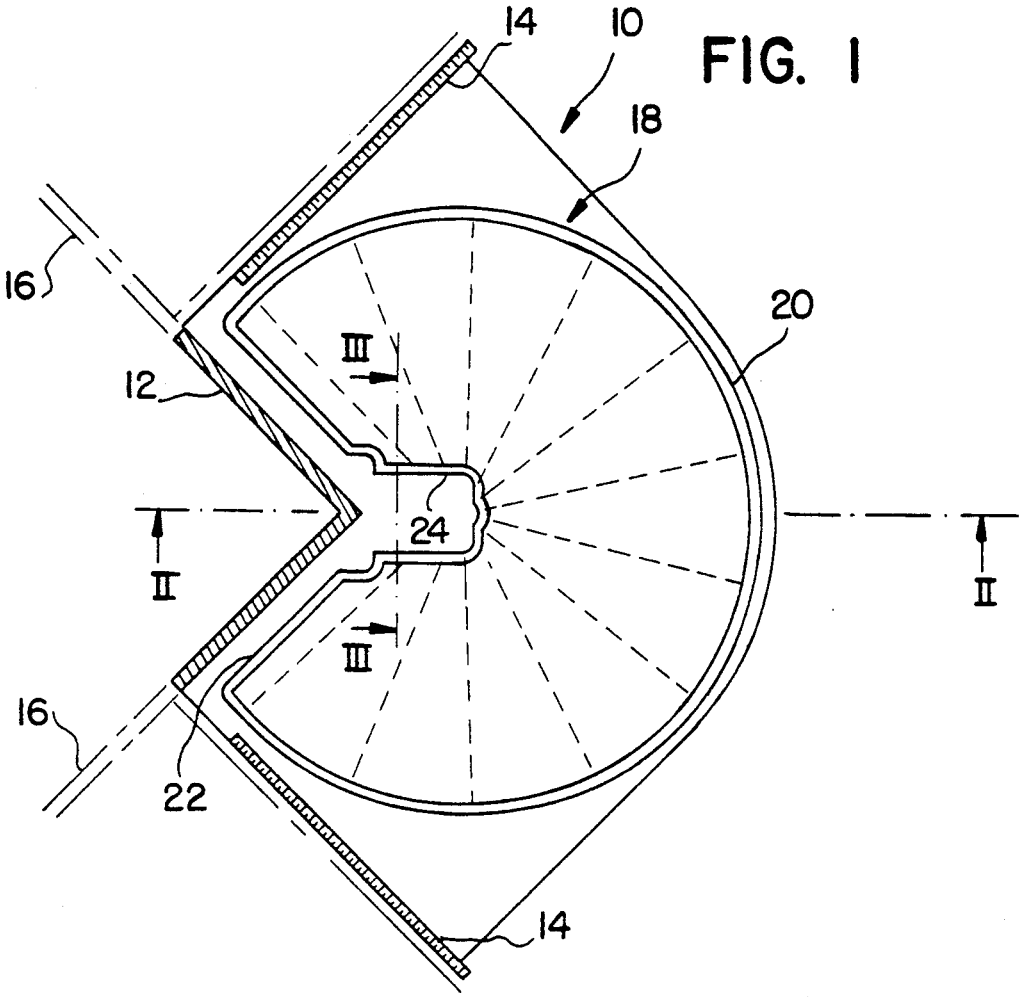
FIG. 1
FIG. 2
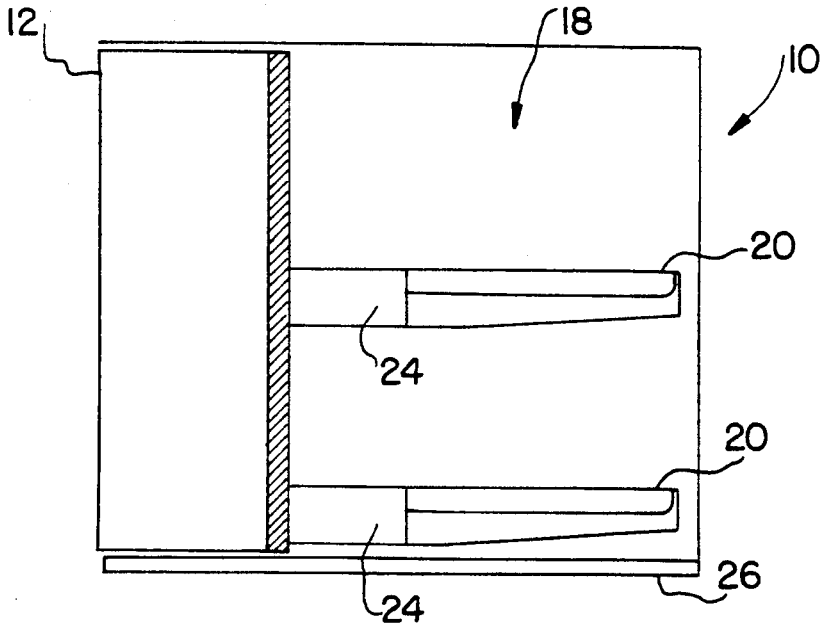

HARDWARE FOR CORNER CABINET

BACKGROUND OF THE INVENTION

The invention relates to a mounting for a corner cupboard door.

In kitchen corner cupboards a carousel rotatable about a vertical axis is often provided, which comprises a plurality of compartment floors spaced apart one above the other and rotatable as a unit. In some corner cupboards of this kind the door is held on the carousel for co-rotation on the carousel. On being opened, the door is first pressed radially inwards, so that it can move past the neighboring cupboard body sides, whereupon it is moved out of the door opening by turning the carousel.

A door mounting for a corner cupboard of this kind is known from German Utility Model 77 36 498. This mounting has a telescopic tube which is disposed midway up the height of the door, between the axis of rotation and the door, and which contains a helical compression spring by which the door is urged outwards into the closed position. Cam disks are disposed on the floor and under the roof of the corner cupboard, each of them having a control cam extending concentrically to the axis of the carousel and having an outwardly directed protuberance in a position corresponding to the closed position of the door. At the top and bottom ends the door is provided with a respective cam follower engaging in the control cam. When the door is open, the cam followers are situated in the circular portions of the control cam, so that the door is held in the inwardly retracted position against the force of the compression spring. When the carousel reaches the starting position, in which the door is in line with the door opening, the cam followers arrive against the protuberances of the control cam and the door is pressed outwards into the closed position. A disadvantage of this mounting is that the fitting and adjustment of the cam disks on the floor and roof of the cupboard body entail heavy expense for installation.

In German Utility Model 87 05 055 a mounting is described in which only a single cam disk on the floor of the cupboard is required. In the case of this mounting the door is fastened to the carousel by means of pivotable links which enable the door to move radially inwards. The links are mounted rigidly on a vertical shaft, so that synchronism between the top and bottom ends of the door is ensured. Although this arrangement achieves a certain simplification in assembly work, nevertheless, just as in the case of the previously described mounting, the disadvantage is that the functional parts of the mounting, which have relatively complicated shapes, are visible and accessible, uncovered, in the interior of the corner cupboard and can be cleaned only with difficulty.

The problem underlying the invention is that of providing a corner cupboard mounting of the type first mentioned above, in which in accordance with the concepts of a modern kitchen design the functional parts are to a large extent invisible and inaccessible to the user and/or have smooth, easily cleaned surfaces According to the present invention, this problem is solved.

SUMMARY OF THE INVENTION

In the mounting according to the invention the telescopic mechanism is formed by interengaging box-shaped parts which extend over the entire height of the space between two compartment floors and thus form a substantially smooth vertical partition in the carousel. At the same time this construction permits firm support of the door, while any mechanisms improving synchronism between the top and bottom ends of the door can be concealed inside the box-like telescopic parts. For the control of the inward and outward movement of the door only a single cam disk, on the floor of the cupboard body, is therefore needed and is concealed by the bottom compartment floor.

Advantageous further developments of the invention made possible by an accurate synchronism of the door, simple installation of the mounting and simple adjustment of the door.

BRIEF DESCRIPTION OF THE DRAWINGS

Preferred examples of embodiment of the invention are explained more fully below with reference to the drawings, in which:

FIG. 1 is a plan view of a corner cupboard having a carousel floor;

FIG. 2 is a section on the line II—II in FIG. 1;

DETAILED DESCRIPTION OF THE PREFERRED EMBODIMENTS

Figure 3:
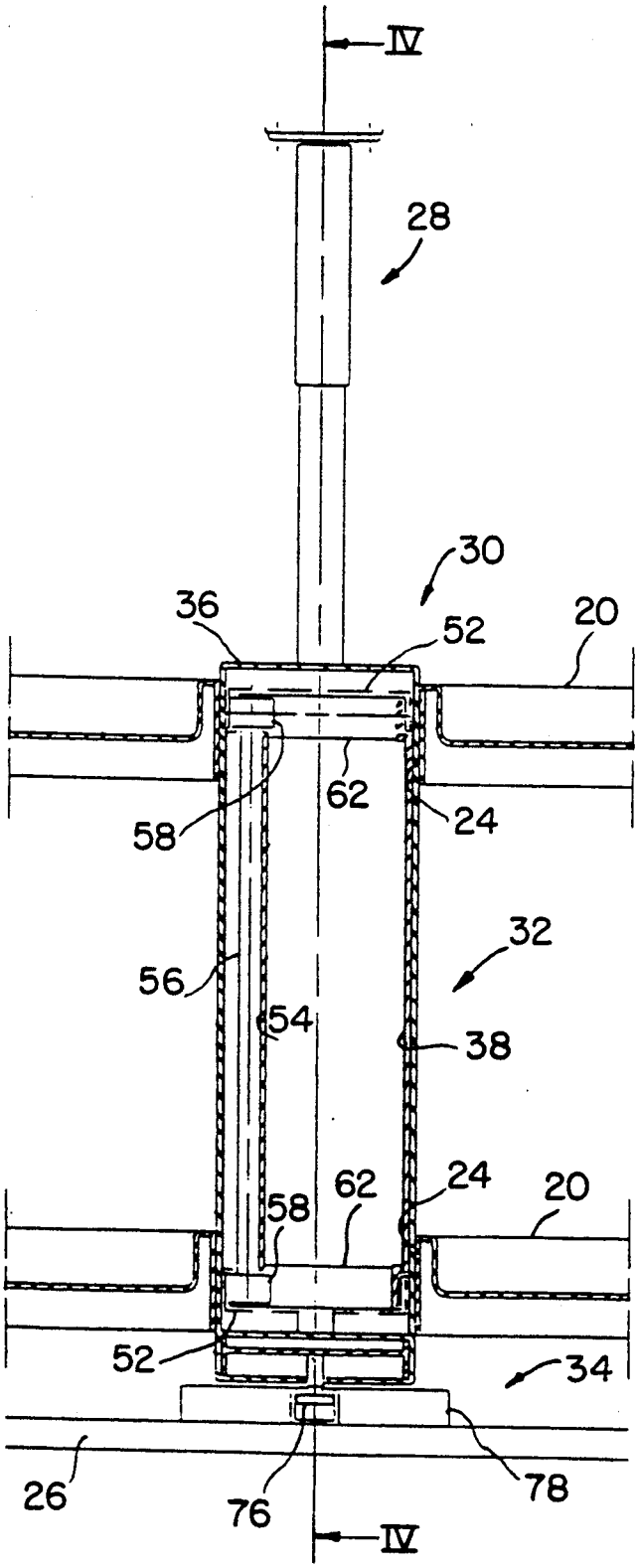
FIG. 3 is a section through a door mounting and the carousel floors on the line III—III in FIG. 1.

In FIGS. 1 and 2 a kitchen corner cupboard 10 having an angle door 12 is shown. The side walls 14 of the corner cupboard are set so far back at the front end, relative to the adjoining cupboard bodies 16, that an inward radial movement of the door 12 is possible. The corner cupboard 10 contains a carousel 18, which is rotatable about a vertical axis and has two substantially circular compartment floors 20. The compartment floors 20 each have a cutout 22 having approximately the shape of a quarter of a circle to receive the angle door 12. A rectangular recess 24 adjoins the base of the cutout 22 and extends to the center of the compartment floor, receiving parts of a door mounting not shown in FIGS. 1 and 2. As can be seen in FIG. 2, the bottom compartment floor 20 is disposed close above the floor 26 of the corner cupboard 10. The compartment floors 20 are rigidly joined to a shaft which is not shown in FIGS. 1 and 2, and which is rotatably mounted on the floor and on the roof of the corner cupboard.

Figure 4:
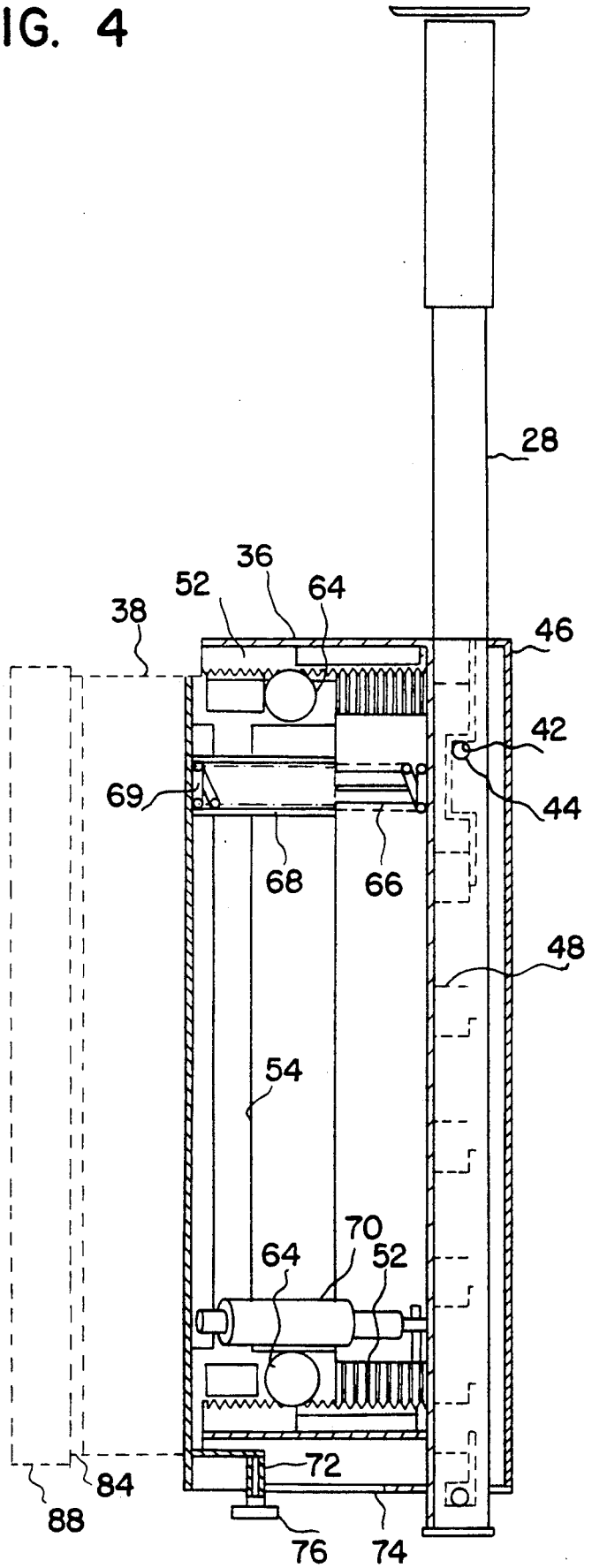
FIG. 4 is a section through the mounting on the line IV—IV in FIG. 3.
Figure 5:
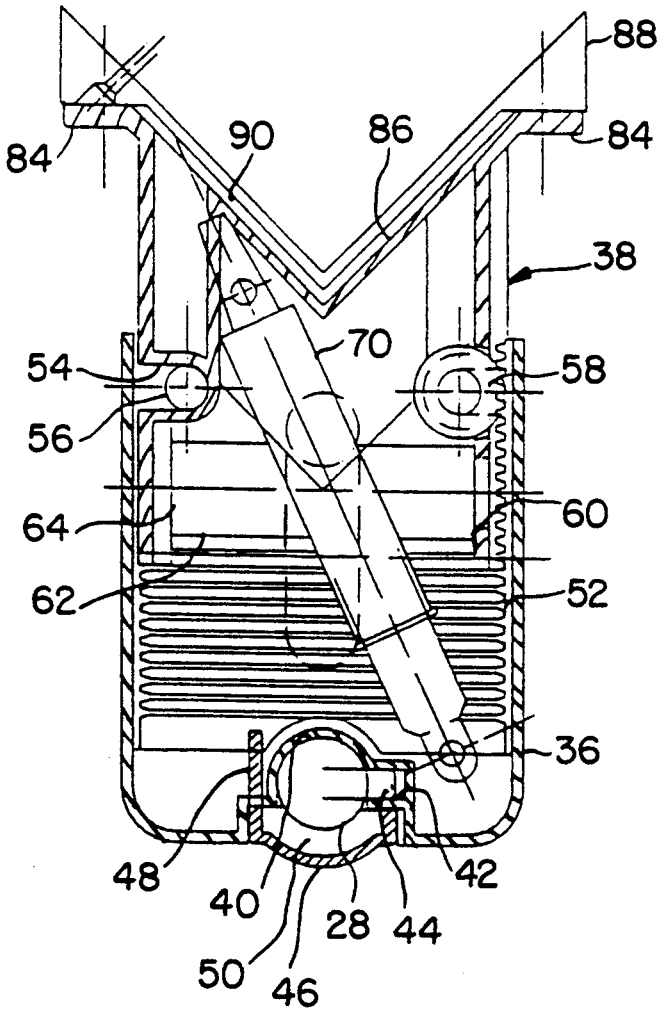
FIG. 5 is a horizontal section through the mounting.

The above-mentioned shaft 28 and the door mounting 30 are shown separately in FIGS. 3 to 5.

The door mounting 30 includes a telescopic mechanism 32 by which the angle door 12 is held for radial movement on the shaft 28 of the carousel 18, and a control cam mechanism 34 which couples the radial movement of the door 12 to the rotary movement of the carousel 18 about the axis of rotation formed by the shaft 28.

The telescopic mechanism 32 comprises a box-shaped telescopic casing 36, which is open in the direction of the angle door 12, and in which a likewise box-shaped door holder 38 is guided. The telescopic casing 36 extends in height from the top face of the upper compartment floor 20 to a point under the bottom face of the lower compartment floor 20 and fits accurately into the recesses 24 in the compartment floors. The compartment floors 20 can be fixed firmly to the telescopic casing 36, for example by means of screws, so that the carousel 18 as a whole is stiffened by the telescopic casing 36. As shown in FIG. 5, the telescopic casing 36 is provided at its inner end with a vertically extending channel 40 adapted to the periphery of the shaft 28. Pockets 42 open at the bottom are formed in the wall of the channel 40 and enable the telescopic casing to be rotationally secured with pins 44 extending transversely through the shaft 28. The channel 40 is closed towards the outside by a clamp strip 46, which is fastened to the telescopic casing 36 by downwardly cranked hooks 48 and which by means of horizontal webs 50 cut out in semicircular shape bear firmly against the periphery of the shaft 28. In this way the telescopic casing 36 is fastened rigidly to the shaft 28.

The telescopic casing 36 contains both at the top end and at the bottom end a toothed bar 52 which has a U-shaped profile and which is provided on the inside with teeth both on its horizontal leg and on its two vertical legs. As shown in FIG. 5, the door holder 38 is provided on each side with a bearing 54, which is open towards the side surface, for a shaft 56 extending in the vertical direction and carrying both at the top end and at the bottom end a gear 58 rotatable with it. The gears 58 mesh with the vertical legs of the toothed bar 52, so that during the inward and outward movement of the door holder 38 in the telescopic casing 36 synchronism is achieved by constraint between the top and bottom ends of the door holder. A bearing 60 for a horizontal shaft 62, which is provided at each end with a gear 64, is inserted into the top and bottom ends of the door holder 38 in positions offset relative to the shafts 56. The gears 64 mesh with the horizontal leg of the toothed bar 52 and thus ensure synchronism between the left-hand and right-hand sides of the door holder 38. When the angle door 12 moves radially relative to the telescopic casing 36, the gears 58 and 64 thus roll on the toothed bar 52, so that a retraction and an extension movement of the door holder 38 can be made with little friction and without tipping in any direction.

As shown in FIG. 4, the telescopic casing 36 and the door holder 38 contain in their interior a spring guide rod 66 and a spring guide tube 68 respectively, which serve to receive a closing spring 69 by which the door is urged radially outwards into the closed position. FIG. 5 also shows a pneumatic closing damper 70 pivoted by its radially outer end inside the door holder 38 and at its other end on the toothed bar 52, for damping the impact of the door in the closed position. FIG. 4 shows a side view of the damper 70.

Figure 7:
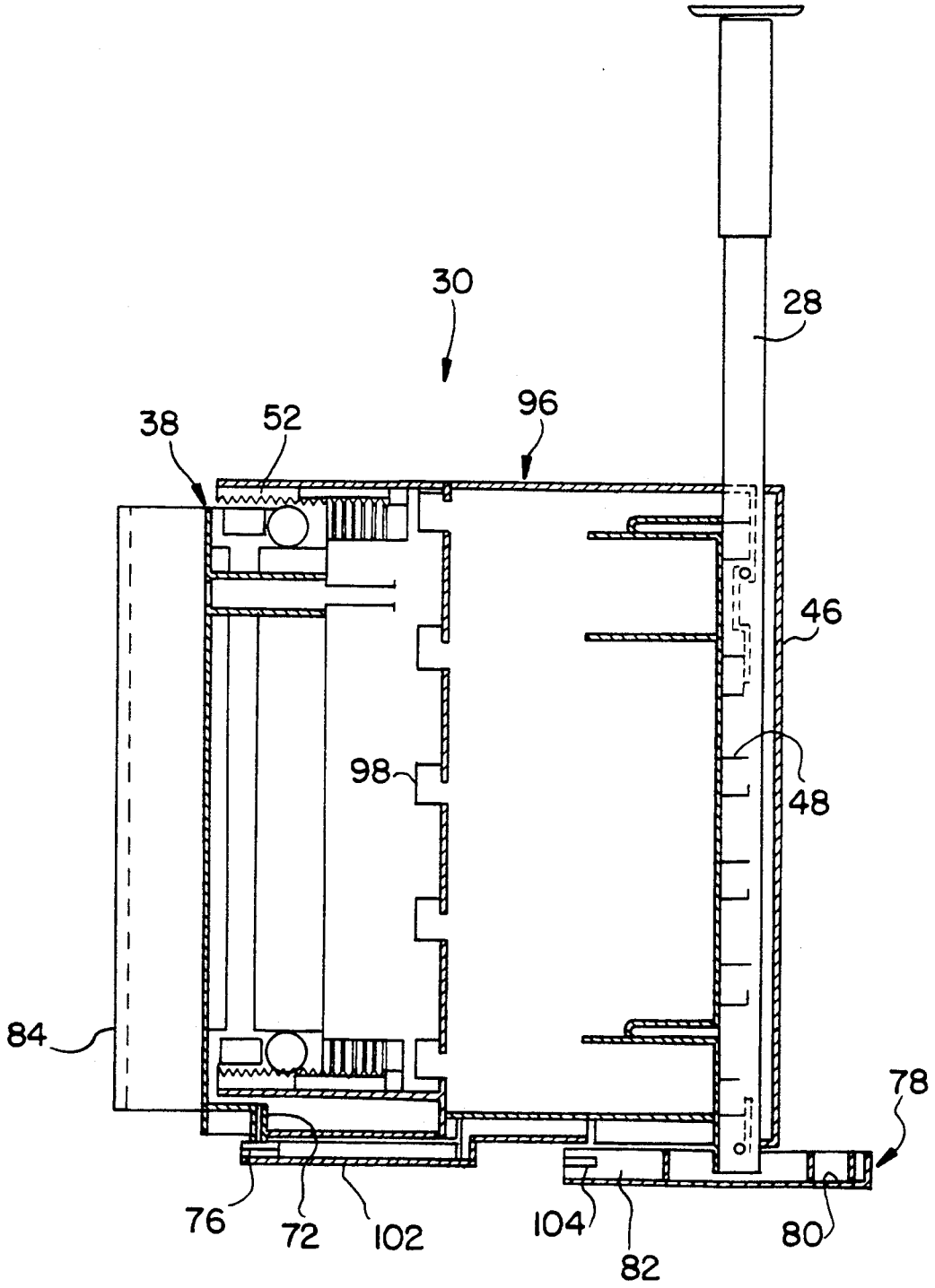
FIG. 7 is a section through a mounting for the door shown in FIG. 6.
Figure 8:
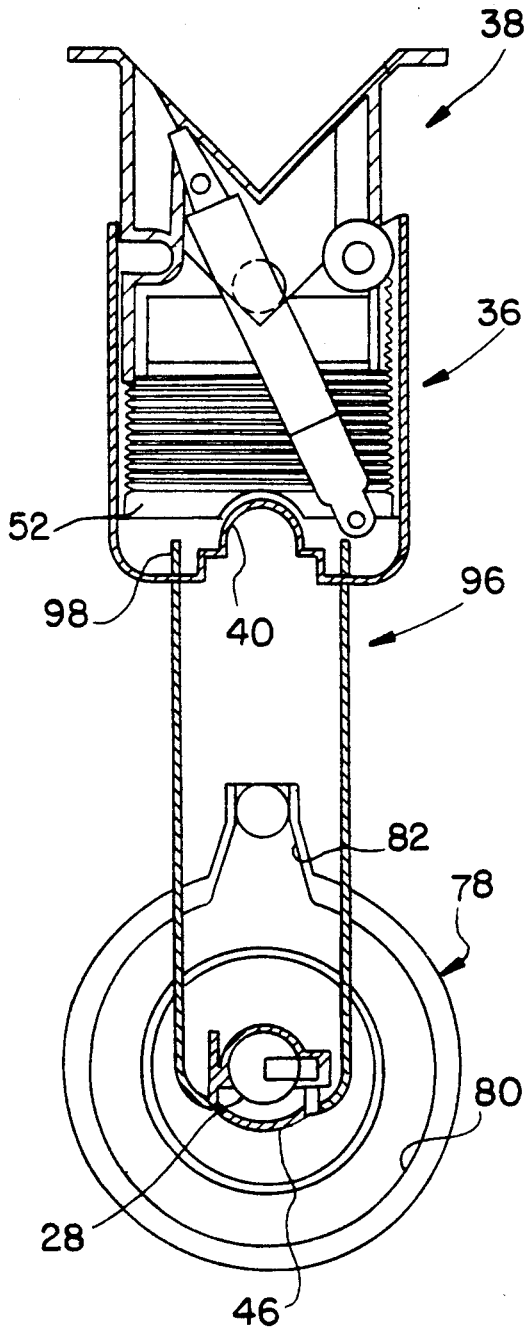
FIG. 8 is a horizontal section through the mounting shown in FIG. 7.

As shown in FIG. 4, the door holder 38 is provided at the bottom end with a radially inward-pointing projection 72, which projects into a slot 74 at the bottom end of the telescopic casing 36 and carries a roller 76 acting as a cam follower. As shown in FIG. 3, the roller 76 engages with a cam disk 78 mounted on the floor 26 of the corner cupboard. Referring now to FIGS. 7 and 8, if the adapter 96 shown in FIGS. 7 and 8 is not used, then the telescopic casing 36 is directly fitted to the shaft 28, as shown in FIGS. 3 and 4, and the roller 76 of FIGS. 3 and 4 assumes the position of the roller 104 shown in FIG. 7, and performs the same function as the roller 104. As can be seen in FIG. 8, the cam disk 78 has a control groove 80 extending annularly around the bottom bearing for the shaft 28 and forming, in a position corresponding to the closed position of the door, an opening 82 directed outwards in the form of a funnel. When the door is closed, the roller 104 lies in the opening 82. When the door is pushed inwards against the force of the closing spring and the carousel 18 is then turned, the roller 104 runs in the annular part of the control groove 80, so that the door is held in a retracted position in which it does not strike against the inner walls of the corner cupboard 10. When the carousel 18 together with the angle door 12 has made a complete rotation, the roller 104 engages once again in the opening 82 through the action of the closing spring, so that the angle door is moved back into the closed position.

The components of the door mounting 30 described above, particularly the telescopic casing 36 and the door holder 38, are in the form of injection moldings of plastic material. The toothed bars 52 and the shafts, together with the gears 58 and 64 respectively formed integrally on them, are preferably made of polyamide, so that no lubrication or maintenance is required for these parts.

The mounting described above can be installed in the following manner.

The telescopic casing 36, together with the door holder 38 and the drive parts contained therein, are already preassembled in the factory. For this purpose the shafts 56, together with the gears 58, and the shafts 62, together with the gears 64, are inserted loose into the bearings 54, 60 provided for them in the door holder 38 and are fastened by attaching the top and bottom toothed bars 52. The closing spring is fitted on the spring guide rod 66 of the telescopic casing 36, and the closing damper 70 is hooked into the door holder 38 and onto the toothed bar 52. The unit comprising the door holder 38 and the toothed bars 52, together with the drive parts, is then inserted into the telescopic casing 36, the toothed bars 52 being supported by their outer contour against the inside surface of the telescopic casing 36 and thus holding the shafts and gears in position. Finally, the toothed bars 52 are fixed in the telescopic casing 36 with the aid of fastening screws (not shown).

The maker of the kitchen units installs the cam disk 78, together with the bottom bearing for the shaft 28, in the corner cupboard 10, and the shaft 28 is inserted into the bottom bearing and fastened by means of a telescopic coupling part to a bearing installed under the roof of the corner cupboard. The compartment floors 20 are inserted in an inclined position into the cupboard by way of the door opening, and are first laid flat on the floor of the corner cupboard in the position shown in FIG. 1. The door 12 can conveniently be fastened to the telescopic mechanism 32 outside the cupboard, and the unit thus formed can then be mounted on the shaft 28. For this purpose the telescopic casing 36 is laid with its channel 40 against the shaft 28 and pushed onto the cross pins 44 by a slight downward movement. The clamp strip 46 is then inserted from the opposite side and hooked in place on the telescopic casing 36 by a downward movement. The floors 20 are then fastened at the desired height to the telescopic casing 36.

At its free end facing the door the door holder 38 has two flanges 84 lying in a common plane at right angles to the direction of retraction of the door holder. Between the flanges 84 a rectangular recess 86 is provided for the door angle. At least two holding angle pieces 88 are screwed to the door 12 and are in turn screwed to the flanges 84. The holding angle piece 88 forms a certain gap 90 with the recess 86, so that the door 12 can be adjusted relative to the door holder 38 not only vertically but also horizontally.

In the depth direction the position of the door 12 is determined by the fact that the gears 58 and/or 64 reach the end of the toothed region of the respective leg of the toothed bars 52. In order to adjust the door 12 in the direction of the depth, the fastening screws for the toothed bars 52 are temporarily loosened and the toothed bars are moved in the telescopic casing 36 and refixed in the desired position. Since the top and bottom toothed bars 52 can be adjusted independently of one another, the inclination of the door 12 can also be adjusted in this way. This may give rise to a slight deviation of the shafts 56 from the vertical, but because of the tooth clearance of the relatively short vertical legs of the toothed bars 52 this can be tolerated without difficulty.

A substantial advantage of the mounting described above consists in that the mounting parts, particularly the drive parts, can be installed with a minimum of screw connections and consequently with relatively low labor costs. For the maker of the kitchen units or the end user it is a substantial advantage that the entire telescopic mechanism is supplied as a preassembled unit, so that stockkeeping and installation are considerably facilitated. In addition, the mounting is distinguished by simple, versatile adjustability.

One possible way of adapting the above-described mounting to different cupboard sizes or cupboard configurations, with the aid of a simple supplementary adapter, will be explained below with reference to FIGS. 6 to 8.

Figure 6:
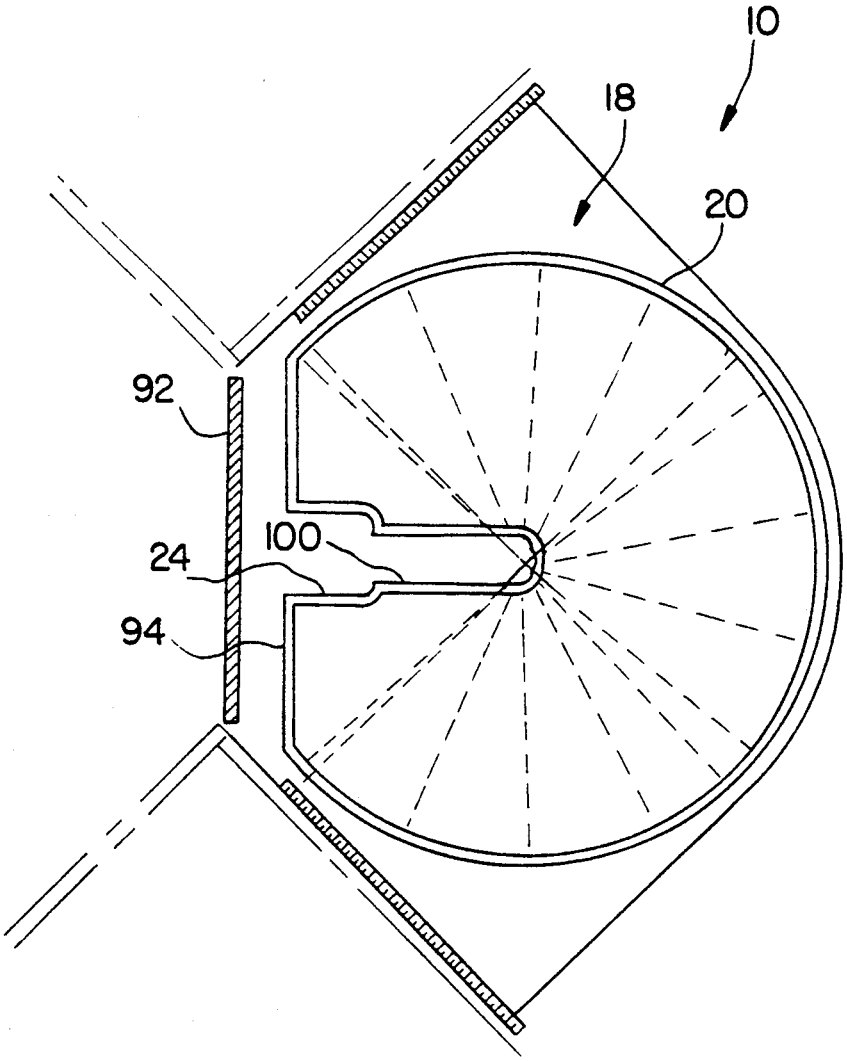
FIG. 6 is a plan view of a corner cupboard having a differently shaped door.

The corner cupboard 10 shown in FIG. 6 differs from that shown in FIG. 1 in that the angle door 12 is replaced by a flat, diagonally disposed door 92. The compartment floors 20 accordingly have only a flat, segmental cutout 94, and the recess 24 for the telescopic casing 36 is at a greater distance from the center of the compartment floor.

In order to bridge the greater distance between the telescopic casing 36 and the shaft 28, according to FIGS. 7 and 8 a slightly narrower box-shaped adapter 96 is provided, which can be clipped to the telescopic casing 36 in place of the clamp strip 46. At its outer end the adapter 96 has a number of upwardly cranked hooks 98 which engage in openings provided for the purpose in the wall of the telescopic casing 36. The upward cranking of the hooks 98 has the effect that the dead weight of the door and of the telescopic mechanism can be positively borne.

At its radially inner end the adapter 96 has the same shape as the telescopic casing 36, so that it can be fastened to the shaft 28 in corresponding fashion with the aid of the clamp strip 46.

The compartment floors 20 are provided according to FIG. 6 with a recess 100 adapted to the contour of the adapter 96.

Instead of the holding angle pieces 88, the door 92 can be fastened to the flanges 84 of the door holder. The roller 76 mounted on the door holder 38 cannot be used in this case and is covered or replaced by a cap 102 which is disposed o the projection 72 and which extends inwards under the adapter 96 and at its inner end carries a roller 104 acting as a cam follower.

What is claimed is:

1. Mounting for a corner cupboard door which is held for co-rotation on a carousel having at least two compartment floors, which mounting comprises a telescopic mechanism for the radially movable fastening of the door on the carousel, and a control cam mechanism which acts between a part fixed to the door and a cupboard body and which maintains the door in an inwardly retracted position when the carousel is rotated out of a starting position, while permitting an outward movement of the door into a closed position when the carousel returns to the starting position, characterized in that the telescopic mechanism has a box-shaped telescopic casing which extends between at least two compartment floors and in which an extensible door holder is guided, which is adapted to the inside contour of the telescopic casing; and further characterized in that a toothed bar is disposed both at the top end and at the bottom end in the telescopic casing, and at least one vertical shaft is provided which at its top and bottom ends is provided with gears meshing with the toothed bars, the door holder being mounted in the telescopic casing via said vertical shaft and said gears so that during the inward and outward movement of the door holder in the telescopic casing synchronism is achieved by constraint between the top and bottom ends of the door holder.

2. Mounting according to claim 1, characterized in that the shafts together with the gears are inserted loose in shell-shaped bearings open towards the outside and are held in position by the toothed bars.

3. Mounting according to claim 1, characterized in that the toothed bars at the same time form stops for limiting the extension movement of the door holder and are adjustable, relative to the telescopic casing, in the direction of the extension of the door holder.

4. Mounting according to claim 1, characterized in that the compartment floors can be fixed on the telescopic casing.

5. Mounting for a corner cupboard door which is held for co-rotation on a carousel having at least two compartment floors, which mounting comprises a telescopic mechanism for the radially movable fastening of the door on the carousel, and a control cam mechanism which acts between a part fixed to the door and a cupboard body and which maintains the door in an inwardly retracted position when the carousel is rotated out of a starting position, while permitting an outward movement of the door into a closed position when the carousel returns to the starting position, characterized in that the telescopic mechanism has a box-shaped telescopic casing which extends between at least two compartment floors and in which an extensible door holder is guided, which is adapted to the inside contour of the telescopic casing; and further characterized in that in the top and/or bottom end in the telescopic casing a shaft is mounted which extends horizontally, transversely to the extension direction and which at its opposite ends is provided with gears which mesh with toothed bars disposed on the inner surfaces of the floor and roof of the telescopic casing, the door holder being mounted in the telescopic casing via said horizontal shaft and said gears so that during the inward and outward movement of the door holder in the telescopic casing synchronism is achieved by constraint between the left-hand and right-hand sides of the door holder.

6. Mounting for a corner cupboard door which is held for co-rotation on a carousel having at least two compartment floors, which mounting comprises a telescopic mechanism for the radially movable fastening of the door on the carousel, and a control cam mechanism which acts between a part fixed to the floor and a cupboard body and which maintains the door in an inwardly retracted position when the carousel is rotated out of a starting position, while permitting an outward movement of the door into a closed position when the carousel returns to the starting position, characterized in that the telescopic mechanism has a box-shaped telescopic casing which extends between at least two compartment floors and in which an extensible door holder is guided, which is adapted to the inside contour of the telescopic casing; and further characterized in that a toothed bar is disposed both at the top end and at the bottom end in the telescopic casing, and at least one vertical shaft is provided which at its top and bottom ends is provided with first gears meshing with the toothed bars, the door holder being mounted in the telescopic casing via said vertical shaft and said first gears so that during the inward and outward movement of the door holder in the telescopic casing synchronism is achieved by constraint between the top and bottom ends of the door holder; and further characterized in that in the top and/or bottom end in the telescopic casing a shaft is mounted which extends horizontally, transversely to the extension direction and which at its opposite ends is provided with second gears which mesh with the toothed bars disposed on the inner surfaces of the floor and roof of the telescopic casing, the door holder being mounted in the telescopic casing via said horizontal shaft and said second gears so that during inward and outward movement of the door holder in the telescopic casing synchronism is achieved by constraint between the left-hand and right-hand sides of the door holder; and further characterized in that the toothed bars have a U-shaped profile and are inserted with an accurate fit into the telescopic casing.

7. Mounting for a corner cupboard door which is held for co-rotation on a carousel having at least two compartment floors, which mounting comprises a telescopic mechanism for the radially movable fastening of the door on the carousel, and a control cam mechanism which acts between a part fixed to the door and a cupboard body and which maintains the door in an inwardly retracted position when the carousel is rotated out of a starting position, while permitting an outward movement of the door into a closed position when the carousel returns to the starting position, characterized in that the telescopic mechanism has a box-shaped telescopic casing which extends between at least two compartment floors and in which an extensible door holder is guided, which is adapted to the inside contour of the telescopic casing; and further, characterized in that the telescopic casing is provided at its radially inner end with a channel to receive a shaft forming the axis of rotation of the carousel and can be fastened to the shaft by a detachable clamp strip covering the channel.

8. Mounting for a corner cupboard door which is held for co-rotation on a carousel having at least two compartment floors, which mounting comprises a telescopic mechanism for the radially movable fastening of the door on the carousel, and a control cam mechanism which acts between a part fixed to the door and a cupboard body and which maintains the door in an inwardly retracted position when the carousel is rotated out of a starting position, while permitting an outward movement of a the door into a closed position when the carousel returns to the starting position, characterized in that the telescopic mechanism has a box-shaped telescopic casing which extends between at least two compartment floors and in which an extensible door holder is guided, which is adapted to the inside contour of the telescopic casing; and further characterized in that a cam follower forming part of the control cam mechanism is disposed on a projection of the door holder under the telescopic casing and an adapter, which adapter can be mounted on a shaft forming the axis of rotation of the carousel and can be detachably joined to a rear side of the telescopic casing, for adapting the mounting to different distances between the door and the shaft; and further characterized by an extension piece which can be mounted on the projection of the door holder to replace the cam follower, and which extends, towards the shaft, under the telescopic casing and the adapter and at its radially inner end carries a second cam follower.

9. A mounting for a corner cupboard door which rotates with a carousel having at least two compartment floors, comprising:

a telescopic mechanism for a radially movable fastening of the door on the carousel, the telescopic mechanism comprising a box-shaped telescopic casing which extends between the at least two compartment floors and an extensible door holder which is guided in the telescopic casing and which is adapted to an inside contour of the telescopic casing;

a control cam mechanism connected between a part fixed to the door and a cupboard body and which maintains the door in an inwardly retracted position when the carousel is rotated out of a starting position, while permitting an outward movement of the door into a closed position when the carousel returns to the starting position;

toothed bars disposed at a top end and at a bottom end in the telescopic casing;

at least one vertical shaft having top and bottom ends; and gears located on the top and bottom ends of the vertical shaft and meshing with the toothed bars.

* * * * *